United States Patent [19]

Corbiere

[11] Patent Number: 5,071,034

[45] Date of Patent: Dec. 10, 1991

[54] DISTRIBUTING DEVICE FOR LIQUID PREPARATIONS

[76] Inventor: Jerome Corbiere, 17, Rue Cortambert, 75016 Paris, France

[21] Appl. No.: 534,459

[22] Filed: Jun. 6, 1990

[30] Foreign Application Priority Data

Dec. 5, 1988 [FR] France ..... 88 15886

[51] Int. Cl.[5] ..... B67D 5/00

[52] U.S. Cl. ..... 222/80; 206/222; 222/129; 222/215

[58] Field of Search ..... 206/222; 222/80, 129, 222/206, 215, 145, 135, 136, 541, 212

[56] References Cited

U.S. PATENT DOCUMENTS 3,024,947 3/1962 Jeynes, Jr. ..... 206/222

3,537,605 11/1970 Solowey ..... 206/222

3,548,562 12/1970 Schwartzman ..... 222/80

3,842,836 10/1974 Ogle ..... 215/6

*Primary Examiner*—Kevin P. Shaver

*Attorney, Agent, or Firm*—Bierman and Muserlian

[57] ABSTRACT

In a distributing device for liquid preparation composed of three parts forming a single unit consisting of a receptacle, an intermediate part of a flexible texture forming a bellows fixed on the neck of the receptacle and an upper part mounted on the top of the bellows forming a reservoir finished by a nozzle closed at its ends. The intermediate part is composed of a flexible sleeve formed of several concentric rings joined together, inside which are arranged two impervious membranes separated by a rigid member having two sharpened extremities arranged vertically, perpendicular to each of the two membranes.

8 Claims, 1 Drawing Sheet

DISTRIBUTING DEVICE FOR LIQUID PREPARATIONS

SUMMARY OF THE INVENTION

Figure 1:
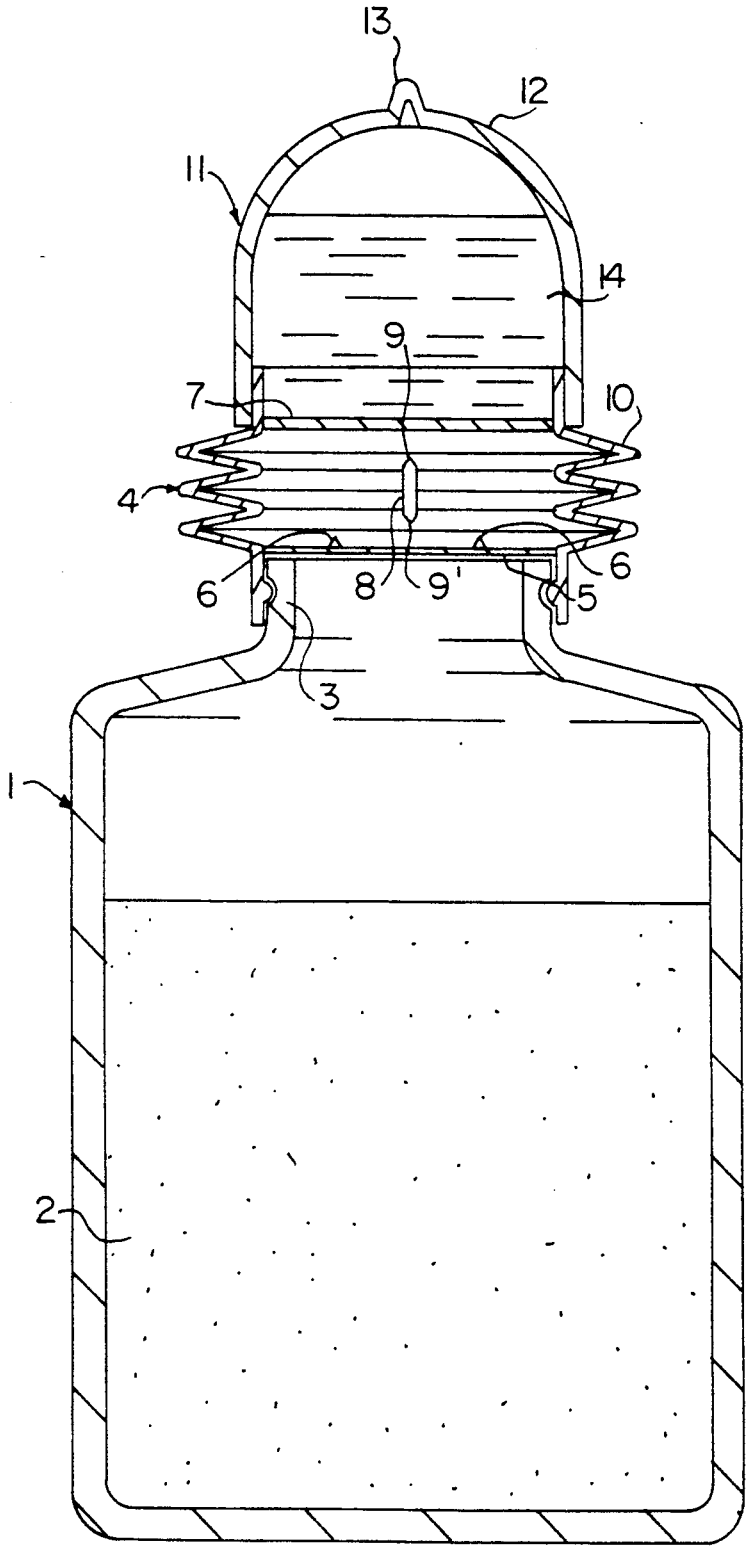

The invention relates to the field of mechanics and more precisely to the field of packaging.

The invention concerns in particular a sealing and distribution device formed of three pieces characterized in that it comprises a receptacle containing a solid or liquid product, a flexible intermediate part fixed in a permanent fashion to the neck of the receptacle, formed of concentric rings joined to one another and inside of which, two impervious membranes are disposed which are joined together by a means of perforation arranged vertically, perpendicular to the plane of the two membranes and an upper part of cylindrically spherical shape terminating in an elongated nozzle closed at its end.

The upper part contains a liquid solvent which is intended to come in contact with the liquid or solid product contained in the receptacle after compression of the flexible intermediate part and perforation of the two membranes.

The solution or suspension produced is distributed by the upper nozzle after cutting the end and inversion of the device.

The device according to the invention can be used in the pharmaceutical industry for the production and distribution of sterile preparations such as opthalmic, auricular and nasal preparations.

PREFERRED EMBODIMENTS

The present invention relates to a distributing device and notably to a distributing device for liquid preparations.

A more particular subject of it is a device of a flask-like type which allows the putting into solution or suspension of a solid or liquid product by the aseptic introduction of a liquid solvent and the distribution of said liquid containing or mixed with the solid or liquid product.

Specifically a subject of it is a new device composed of three parts; a receptacle in which the product to be put in contact with the liquid is found, an intermediate part of a flexible texture fitted onto the neck of the receptacle forming a bellows and an upper part of oblong shape forming a reservoir, terminated by a nozzle which is closed at its end.

This device forms a single unit allowing the passage of a liquid solvent from the upper part of the device into the lower part by pressure exerted on the intermediate part forming a bellows, then when the liquid solvent has come in contact with the solid or liquid product, enabling the distribution of the resulting solution or suspension by means of the nozzle after inversion of the device, without introducing air and without, if necessary, compromising the sterility.

The intermediate part of the device is an important element of the invention because it performs several functions. Firstly it comprises a barrier which stops the liquid contained in the upper part having access to the lower part due to two membranes placed symmetrically on the inside of said bellows, then it allows the passage of said liquid through the two septums ensuring their perforation with a rigid means of perforation and presenting two pointed extremities disposed vertically, perpendicular to each of the two membranes. The pressure exerted on the bellows ensures the perforation of the upper membrane, this allows the descent of the liquid solvent into the inside of the bellows then the tearing of the lower membrane, and thus leads to the penetration of the contents of the receptacle by the liquid solvent.

The bellows is constituted by a flexible sleeve formed by several concentric rings, joined-together, and inside of which is found the upper membrane which is composed of a ring of semi-rigid plastic material and a lower membrane of easily tearable rigid material. Between these two disks, the means of perforation is located and is constituted by a small rigid rod having at each of its ends, a sharpened part. These sharpened parts can be of the same material as the rod if this is of a sufficient hardness or even of another harder material and which will ensure the simultaneous perforation of the two membranes inside the said bellows. If appropriate, the lower membrane can be provided with bumps arranged towards the inside which at the time of bringing the two membranes into contact will produce a more significant or more multiple perforation than that produced by the means of perforation and therefore will ensure a more extensive perforation and a quicker bringing together of the liquid solvent with the powder or liquid product contained in the receptacle.

This bellows is fixed to the neck of the receptacle by clamping or by screwing onto a symmetrical filet carried by the neck of the receptacle or by fastening on an edge of the neck. The neck of the receptacle can also carry fluting, ribbing or dimples allowing for a perfect fixing of the bellows onto the neck of the flask without any risk that this becomes unfastened during the application of pressure or that the liquid solvent leaks between the body of the bellows and the throat of the flask. Preferably, the bellows is fitted into the neck of the flask and this assembly shows no discontinuity.

The upper oblong part is fixed in a permanent fashion to the bellows hot or cold forming, in a manner such that these two parts of the device according to the invention are assembled in a permanent and perfectly impervious fashion.

The terminal nozzle is of the same material as the upper part. It ends in an exremity which is slightly softened in a way that ensures it can be cut when used.

In one preferred embodiment of the invention, the device is defined more precisely by the following characteristics:

1. the receptacle is a flask of glass or rigid or semi-rigid plastic in which the solid or liquid product to be brought in contact with the liquid solvent is placed beforehand. The neck of said receptacle receives the intermediate portion forming a bellows, by clamping or screwing depending on the nature of the material of which both of the pieces are formed. The intermediate part and the neck of the flask can be welded together if they are made in a heat-fusible material.

2. the intermediate part forming the bellows, fixed to the neck of the receptacle, is composed of four or five concentric flexible rings having however sufficient rigidity to support the upper oblong portion and to comfortably ensure pressure on these rings. The pressure will be of a nature which brings the means of perforation into contact with the two membranes in such a way that their perforation is ensured. This intermediate part will be, moreover, of an appropriate height to ensure prehension by pressing on the lower and upper edges without the pressure to be exerted requiring a significant physical effort. Simple finger pressure should be suitable to ensure this double perforation and allow the passage of the liquid solvent.

3. the upper part of the device according to the invention forms a permanent unit with the belows. It presents a cylindrical part which finishes in a portion in the shape of a dome which is more or less spherical or ovoidal. The top of the nozzle is in the form of a small tube of a few millimeters which ensures the dispensing of the solution or of the suspension produced.

The attached diagram shows a preferred embodiment of the device according to the invention. It shows, in a cutaway view, the receptacle (1) in which the liquid or solid phase (2) is introduced. The neck of the receptacle (3) containing the bellows device (4). The cutaway view shows the lower membrane (5) optionally carrying points or bumps (6), the upper membrane (7) and the shank of the perforation device (8) positioned between the two membranes and finished by two sharpened portions (9) and (9'). The shank of perforation device (8) is fixed to the two membranes (5) and (7) by single clamping ensuring a single contact at the outset.

The two membranes (5) and (7) are positioned inside the flexible rings (10) of the bellows part (4), the space between the two membranes is determined by the length of the shank ensuring perforation. In the case under consideration, the total height of the bellows part (4) is of the order of 15 to 20 mm. It is formed of four rings and the length of the perforating shank (8) is from 5 to 10 mm finished by two sharpened portions (9) and (9') of approximately 0.5 mm to 2 mm each.

The thickness of the membranes (5) and (7) is of the order of 6 to 9/10 th's of a mm (0.6 to 0.9 mm). The thickness of the upper membrane (7) can be a little greater than that of the lower membrane (5) so as to ensure perfect imperviousness and air-tightness.

The membrane (5) must not be too thick, so as to avoid a technical problem with its clean perforation. It will preferably have a thickness of 6/10 of a mm (0.6 mm).

The liquid solvent contained in the upper oblong portion (11) rests on the membrane (7) without completely filling the volume defined by the domed portion (12). The nozzle forming the feed nozzle (13) derives from the stretching or assemblage of the dome (12) and is attached to the dome (12) in a fixed and permanent fashion. This nozzle is sealed by a thickening of the side wall (13) which is torn or cut before use.

The upper portion of the device according to the invention is of a cylindrically spherical oblong shape finished by a cylindrical capilary extension piece which forms a feed nozzle. This part of the device is formed of rigid material such as polyethylene or polypropylene or polystyrene.

The two membranes arranged in the bellows are of a different nature. The lower membrane, at the base of the bellows, is a film of aluminium sufficiently thin so as to be easily perforated by pressure of the shank of the small rod but sufficiently rigid to guarantee the imperviousness of the device before perforation and if necessary the sterility.

The solvent (14) contained in the part (11) is preferably an aqueous solvent or an alcoholic solvent or a glycolic solvent which does not attack the material of which the oblong part (11) is made. Essentially it is an aqueous solvent such as a solution of a buffer agent or physiological serum or even distiled water.

Also aqueous solutions of propylene glycol, glycerol or polyethylene glycol can be used. The solvent can be very fluid or very viscous without causing flow problems.

The solid or liquid product (2) placed in the receptacle (1) is in general a medicinal active ingredient soluble or dispersible or miscible in the solvent (14). In this respect, there can be cited, anti-inflammatory products of aryl acetic acid or aryl propionic acid or aryl butanoic acid type. One preferred example would be indomethacin.

The device according to the invention is filled under sterile conditions or in a sterile atmosphere or also under laminar flow. After filling, the whole device is sterilised with ethylene oxyde or by exposure to UV rays or also by ionising radiation.

The bringing into contact of the solvent and the product (2) is effected by agitation or rotation of the receptacle until a homogeneous phase is obtained according to how soluble or dispersible the product is in the solvent.

The resultant solution or suspension allows ready to use sterile liquid preparations to be obtained, as for example collyria or preparations for opthalmic use or also nasal or otological preparations.

What is claimed is:

1. In a distributing device for liquid preparation composed of three parts forming a single unit consisting of a receptacle, an intermediate part of a flexible texture forming a bellows fixed on the neck of the receptacle and an upper part mounted on the top of the bellows forming a reservoir finished by a nozzle closed at its end, the improvement comprising that the intermediate part is composed of a flexible sleeve formed of several concentric rings joined together, inside which are arranged two impervious membranes separated by a rigid means of perforation having two sharpened extremities arranged vertically, perpendicular to each of the two membranes.

2. A distributing device according to claim 1 in which the receptacle is filled with one of a liquid or a solid product.

3. A device according to claim 1 in which the upper part is in the form of an oblong cylinder fixed in a permanent fashion to the bellows and on top of which is a portion in the shape of a spherical or ovoidal dome, which is finished by said nozzle.

4. A device according to claim 1 in which the receptacle is a rigid or semi-rigid flask.

5. A device according to claim 1 in which the intermediate portion forming the bellows is clamped or screwed onto the neck of the receptacle.

6. A device according to claim 1 in which the upper membrane has a thickness of 0.6 mm to 0.9 mm.

7. A device according to claim 1 in which the lower membrane has a thickness of 0.6 mm to 0.9 mm.

8. A device according to claim 1 in which the means of perforation is a rigid shank of 5 to 10 mm finished at each extremity with a sharpened part of about 0.5 mm to 2 mm each.

* * * * *